US008639161B2

(12) United States Patent
Nishizawa

(10) Patent No.: US 8,639,161 B2
(45) Date of Patent: Jan. 28, 2014

(54) IMAGE FORMING APPARATUS WITH MOVABLE PRESSING MEMBER

(75) Inventor: Yuki Nishizawa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 287 days.

(21) Appl. No.: 13/155,590

(22) Filed: Jun. 8, 2011

(65) Prior Publication Data

US 2011/0318069 A1 Dec. 29, 2011

(30) Foreign Application Priority Data

Jun. 25, 2010 (JP) ..... 2010-144362

(51) Int. Cl.
*G03G 15/08* (2006.01)

(52) U.S. Cl.
USPC ..... 399/121; 399/66; 399/297; 399/308

(58) Field of Classification Search
USPC ..... 399/66, 121, 308, 297, 299
See application file for complete search history.

(56) References Cited

U.S. PATENT DOCUMENTS

| | | | | |
|---|---|---|---|---|
| 6,029,037 | A * | 2/2000 | Ito | 399/310 |
| 2009/0202281 | A1* | 8/2009 | Doda et al. | 399/313 |
| 2010/0278567 | A1* | 11/2010 | Nakagawa et al. | 399/310 |
| 2011/0188902 | A1* | 8/2011 | Katagiri et al. | 399/308 |

FOREIGN PATENT DOCUMENTS

| | | | |
|---|---|---|---|
| JP | 3388535 | B2 | 3/2003 |
| JP | 2009-48051 | A | 3/2009 |

* cited by examiner

*Primary Examiner* — David Gray
*Assistant Examiner* — Francis Gray
(74) *Attorney, Agent, or Firm* — Fitzpatrick, Cella, Harper & Scinto

(57) ABSTRACT

An image forming apparatus includes an image bearing member bearing a toner image, an endless rotatable transfer belt for transferring the toner image from the image bearing member to a transfer material, and a transfer device transferring the toner image from the image bearing member to the transfer belt. The transfer device includes a sheet member, one end of which is fixed and the other end of which comes in contact with an inner peripheral surface of the transfer belt, and a pressing member for pressing the sheet member to the transfer belt. In addition, a moving unit moves the pressing member in a moving direction of the transfer belt so that a contact state of the sheet member with respect to the transfer belt is changed.

14 Claims, 8 Drawing Sheets

IMAGE FORMING APPARATUS WITH MOVABLE PRESSING MEMBER

BACKGROUND OF THE INVENTION

1. Field of the Invention

The present invention relates to an image forming apparatus transferring a toner image to a transfer material.

2. Description of the Related Art

Conventionally, there has been known an image forming apparatus having a plurality of photosensitive drums arranged laterally in a line and having an intermediate transfer belt as a transfer belt or a conveyor belt conveying a transfer material. Japanese Patent Application Laid-Open No. 2009-048051 discloses an image forming apparatus having a transfer device including a sheet member and an elastic member, wherein the elastic member presses the sheet member to the intermediate transfer belt at a position facing a photosensitive drum so as to be stably in contact with each other to form a desired nip portion. In comparison with a transfer device contacting a transfer roller with the intermediate transfer belt, the transfer device including the sheet member and the elastic member can form a desired contact region between the sheet member and the intermediate transfer belt and thus has the advantage of providing a high-quality image and a small-sized device.

When a single color image is formed, it is desirable to suppress an increase in rotation torque of the intermediate transfer belt by releasing the contact state between the transfer device corresponding to other colors and the intermediate transfer belt.

However, the configuration in which the transfer device including the sheet member and the elastic member is abutted against and separated from the intermediate transfer belt has a difficulty in suppressing a change in position of the contact region. The configuration of separating the entire transfer device from the intermediate transfer belt complicates the separation mechanism.

SUMMARY OF THE INVENTION

In view of this, the present invention provides an image forming apparatus having a transfer device including a sheet member and an elastic member, the image forming apparatus capable of suppressing a change in position of the contact region and releasing pressure by the elastic member without separating the entire transfer device from the transfer belt.

Another purpose of the present invention is to provide an image forming apparatus, including: an image bearing member bearing a toner image; an endless rotatable transfer belt for transferring the toner image from the image bearing member to a transfer material; a transfer device transferring the toner image from the image bearing member to the transfer belt, the transfer device having a sheet member, one end of which is fixed and the other end of which comes in contact with an inner peripheral surface of the transfer belt, and a pressing member for pressing the sheet member to the transfer belt; and a moving unit moving the pressing member to a first pressing position in which the pressing member presses the sheet member to the transfer belt and a second pressing position which is located farther away from a part of the sheet member pressed by the pressing member in the first pressing position than the first pressing position.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, a color image forming apparatus according to the present invention is described in greater detail with reference to the drawings.

First Embodiment

Figure 1:
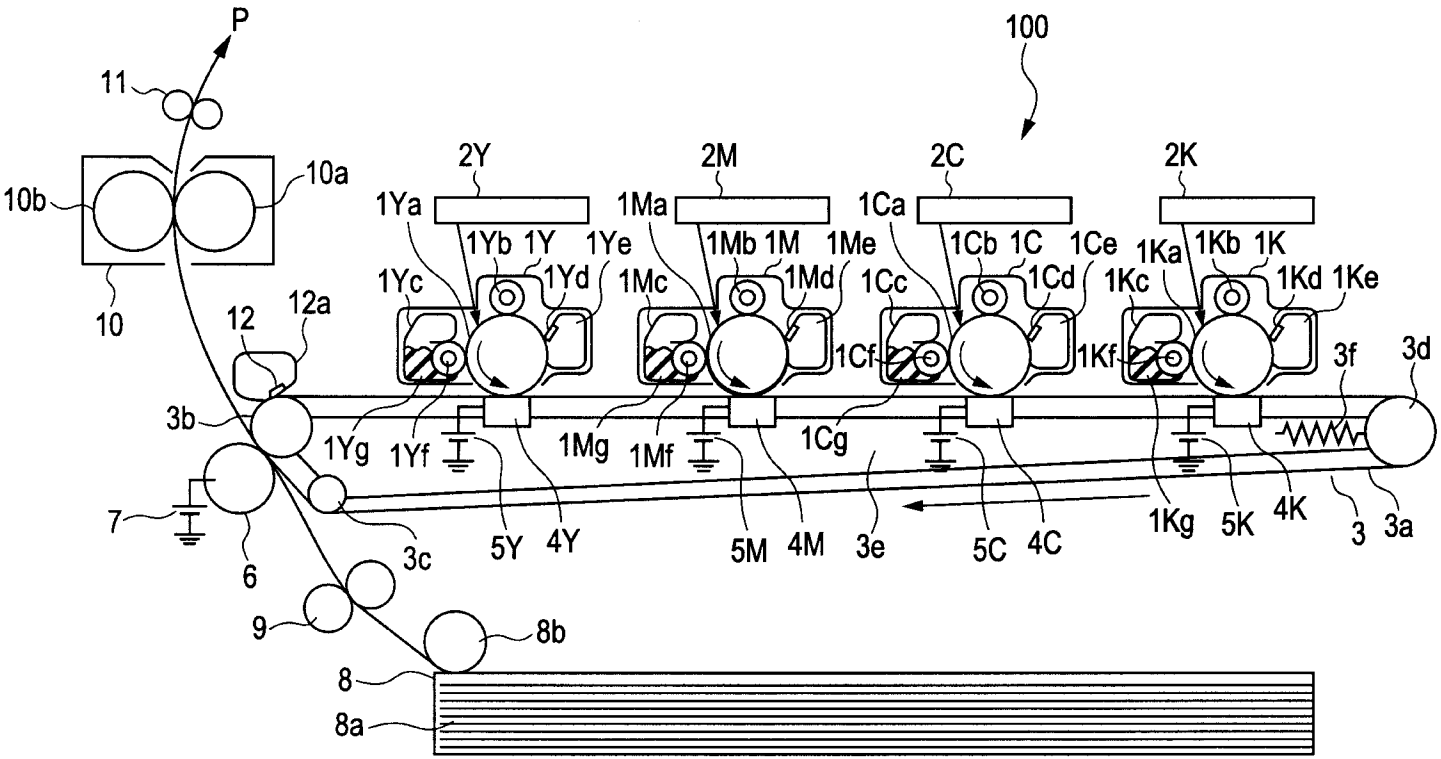
FIG. 1 is a configuration diagram of an image forming apparatus according to a first embodiment.

An image forming apparatus according to a first embodiment of the present invention will be described by referring to the accompanying drawings. FIG. 1 is a configuration diagram of a color image forming apparatus according to the present embodiment. As illustrated in FIG. 1, an image forming apparatus 100 has detachable process cartridges 1Y, 1M, 1C, and 1K. Photosensitive drums (image bearing member) 1Ya to 1Ka are charged by charging rollers 1Yb to 1Kb, and then are exposed by laser units 2Y to 2K to form respective electrostatic latent images. The respective electrostatic latent images are developed by developing rollers 1Yf to 1Kf using toner 1Yg to 1Kg in developing containers 1Yc to 1Kc to form respective color toner images.

An intermediate transfer belt unit 3 includes an endless intermediate transfer belt 3*a* as the transfer belt and three tension rollers (a drive roller 3*b*, a secondary transfer facing roller 3*c*, and a belt tension roller 3*d*). A bias with a polarity opposite to the toner is applied to the transfer devices 4Y, 4M, 4C, and 4K from primary transfer power supplies 5Y to 5K respectively to transfer respective toner images on the intermediate transfer belt 3*a*. The toner remaining on the surfaces of the photosensitive drums 1Ya to 1Ka is removed by cleaning blades 1Yd to 1Kd.

A transfer material P stored in a cassette 8*a* of a feed conveying unit 8 is fed by a feed roller 8*b* and is conveyed by a registration roller pair 9 to a nip portion between a secondary transfer roller 6 and the intermediate transfer belt 3*a*. When a secondary transfer roller power supply 7 applies voltage to the secondary transfer roller 6, a toner image is transferred to the transfer material P.

The transfer material P on to which the toner image is transferred is conveyed to a fixing apparatus 10, and then the transfer material P is heated and pressed by a fixing roller 10*a* and a pressure roller 10*b* to fix the toner image. The transfer material P is discharged to a discharge tray (not shown) by a discharge roller pair 11. The toner remaining on the intermediate transfer belt 3*a* after secondary transfer to the transfer material P is removed by a cleaning blade 12 and is collected into a waste toner collecting container 12*a*.

(Configuration of Transfer Device)

Figure 2:
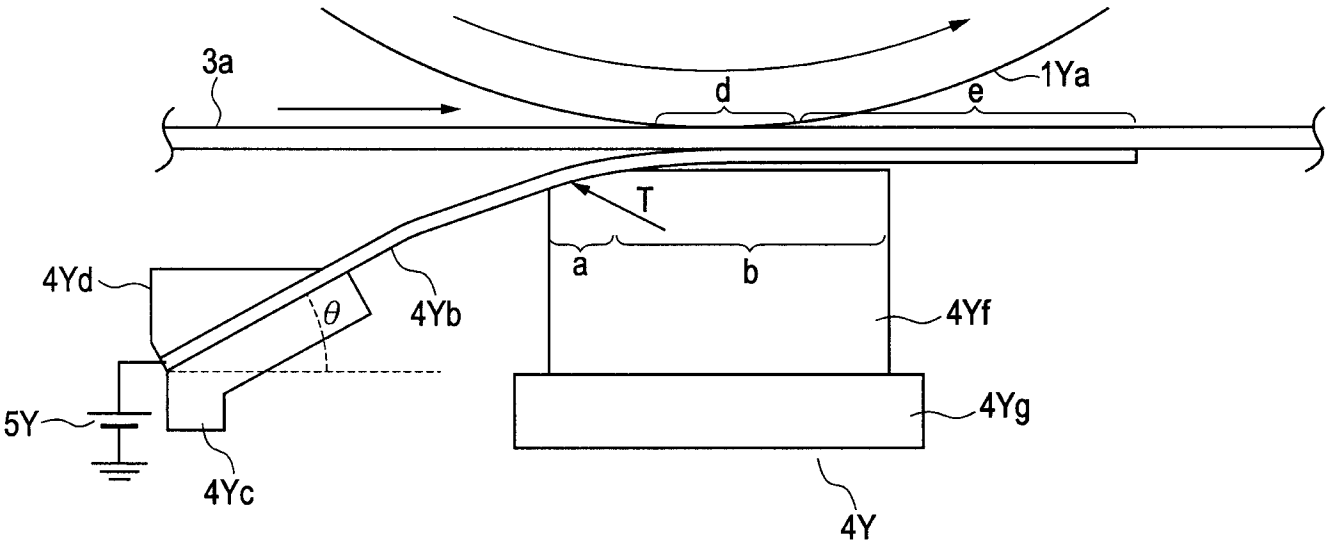
FIG. 2 is a configuration diagram of a transfer device according to the first embodiment.

The transfer devices 4Y to 4K have the same configuration, and thus the configuration of the transfer device 4Y will be described. FIG. 2 is a configuration diagram of the transfer device 4Y. As illustrated in FIG. 2, the transfer device 4Y is arranged on the opposite side of the photosensitive drum 1Ya with the intermediate transfer belt 3*a* sandwiched therebetween. The transfer device 4Y has a sheet member 4Yb and an elastic member 4Yf. The elastic member 4Yf is a pressing member for pressing the sheet member to the transfer belt.

The sheet member 4Yb is pressed from an opposite side of the photosensitive drum 1Ya in a direction indicated by an arrow T by the elastic member 4Yf so as to contact with an inner peripheral surface of the intermediate transfer belt 3*a*. One end (fixed end) of the sheet member 4Yb on an upstream side in a belt moving direction is supported by a sheet support portion 4Yc and a sheet cover 4Yd, and the other end of the sheet member 4Yb on the opposite side (an end portion on a downstream side) contacts with the intermediate transfer belt 3*a* as a free end. The fixed end of the sheet member 4Yb is supported at an angle of $\theta=30°$ with respect to the belt moving direction. The position of the sheet member 4Yb is controlled by the sheet support portion 4Yc and the sheet cover 4Yd.

The elastic member 4Yf has an inclined surface on a side of the intermediate transfer belt 3*a* and on an upstream side in the belt moving direction. The inclined surface is a pressing surface for pressing the sheet member 4Yb. The elastic member 4Yf strongly presses the sheet member 4Yb in a region a. In a region b closer to a downstream side in the belt moving direction than the region a, the elastic member 4Yf presses the sheet member 4Yb with a force less than that in the region a or is in a contactless state. The elastic member 4Yf is held by a holding member 4Yg.

As thus configured, the photosensitive drum 1Ya and the intermediate transfer belt 3*a* form a desired transfer nip. The transfer nip can be divided into a physical nip d and a downstream tension nip e. The physical nip d is a contact portion in which the intermediate transfer belt 3*a* is sandwiched between the photosensitive drum 1Ya and the sheet member 4Yb. The downstream tension nip e is a portion in which the photosensitive drum 1Ya does not contact with the intermediate transfer belt 3*a* while only the intermediate transfer belt 3*a* and the sheet member 4Yb are in contact with each other. In the present embodiment, the transfer nip can have a nip width of about 4 mm: the physical nip d is 2 mm wide and the downstream tension nip e is 2 mm or more wide. When the physical nip d is equal to or less than 1 mm, excellent transfer capability cannot be obtained. Thus, the physical nip d is secured to have 1 mm or more to secure excellent transfer capability.

When a tension nip exists on an upstream side of the physical nip d, a toner image on the photosensitive drum 1Ya may be transferred before entering the physical nip d, which may cause an image failure such as a scattered toner image. Thus, the tension nip is formed only on the downstream side of the physical nip d, but not on the upstream side thereof to suppress an image failure such as a scattered toner image.

Figure 3A:
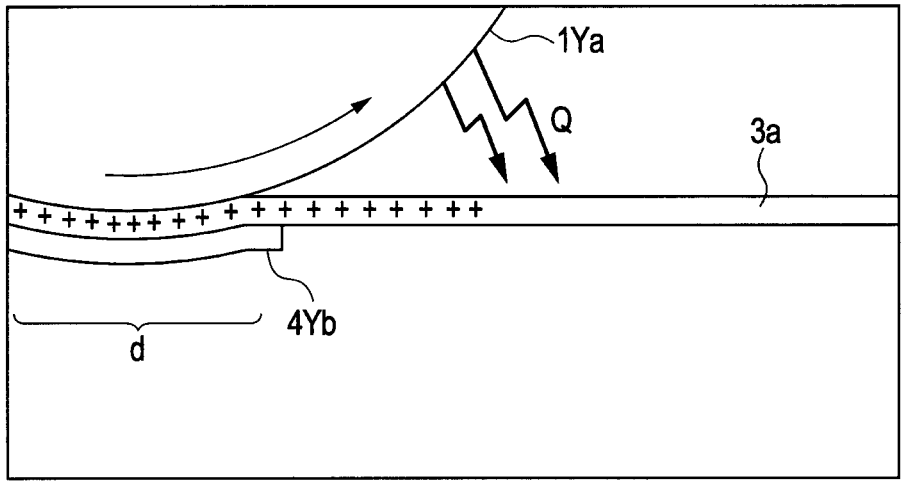
FIGS. 3A and 3B describe charge movement in the transfer device.
Figure 3B:
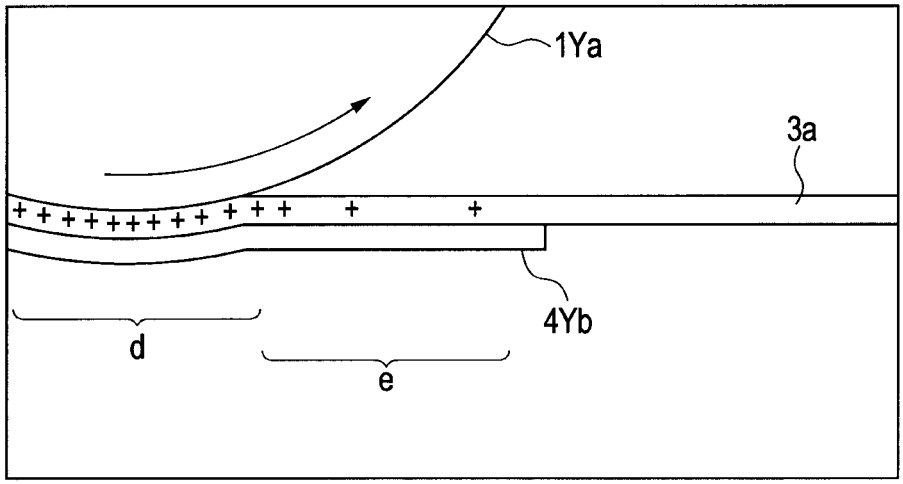

FIG. 3A describes the process of generating a separation discharge Q. FIG. 3B describes the process of removing a positive charge. As illustrated in FIGS. 3A and 3B, positive charges (indicated by + sign in FIG. 3A) supplied through the sheet member 4Yb are accumulated in the intermediate transfer belt 3*a*. When the downstream tension nip e is too short, as illustrated in FIG. 3A, the accumulated positive charges + cause separation discharges Q between the photosensitive drum 1Ya and the intermediate transfer belt 3*a* on a downstream side in the belt moving direction. When a separation discharge Q occurs, the toner image is disturbed, causing an image failure.

When the downstream tension nip e has a sufficient width, as illustrated in FIG. 3B, positive charges + are removed by the downstream tension nip e, and thus no separation discharge Q occurs. Therefore, the downstream tension nip e is formed to have a width of 2 mm or more to suppress a separation discharge and an image failure.

The sheet member 4Yb is made of super-high-molecular polyethylene with a length of 15 mm in the belt moving direction, a thickness of 200 μm, and a volume resistance of $10^3$ to $10^4$ Ωcm at 5 V. The volume resistance was measured by means of an ultra-high resistance meter R8340A (manufactured by Advantest Corporation) and a sample box TR42 for ultra-high resistance measurement (manufactured by Advantest Corporation), having a main electrode plate with a diameter of ϕ22 mm and a guard ring electrode plate with an internal diameter of 41 mm and an external diameter of 49 mm. In the present embodiment, a polyethylene sheet was used as the sheet member 4Yb, but a conductive sheet made of polycarbonate, polyvinylidene fluoride, polyethylene terephthalate, polyimide, vinyl acetate, polyamide, or the like or a sheet whose surface is covered with conductive coat may be used.

The elastic member 4Yf is a urethane foam sponge-like elastic member having an approximately cuboid shape with a thickness of 5 mm and a width of 5 mm, made of an elastic member having an Asker C hardness of 18 degrees at kg load. In the present embodiment, a urethane foam sponge was used, but a rubber material such as epichlorohydrin rubber, acrylonitrile butadiene rubber, and epichlorohydrin-based rubber may be used or a solid elastic rubber material may be used. The elastic member 4Yf is not limited to a rubber material as long as it has an elastic force, and the elastic member 4Yf made of resin or elastomer can exert similar effects. The sheet cover 4Yd is made of acrylonitrile butadiene styrene resin. The sheet support portion 4Yc is made of stainless plate.

Figure 4A:
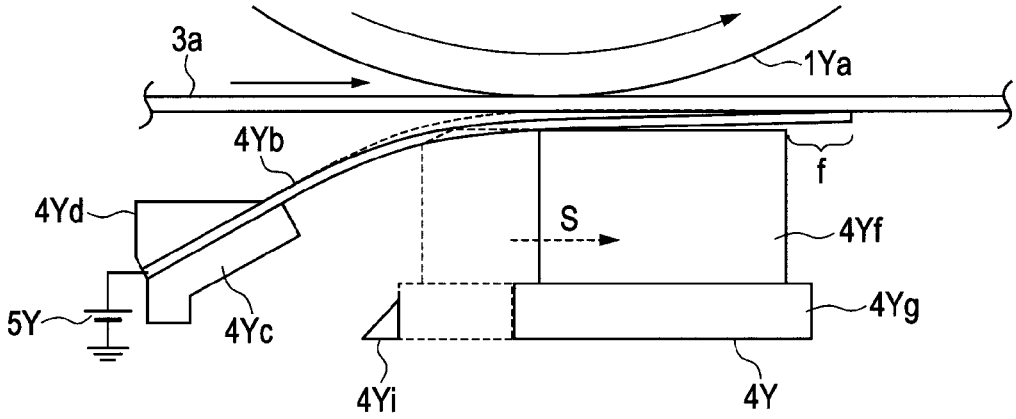
FIGS. 4A and 4B describe a pressure force change unit of the transfer device according to the first embodiment.
Figure 4B:
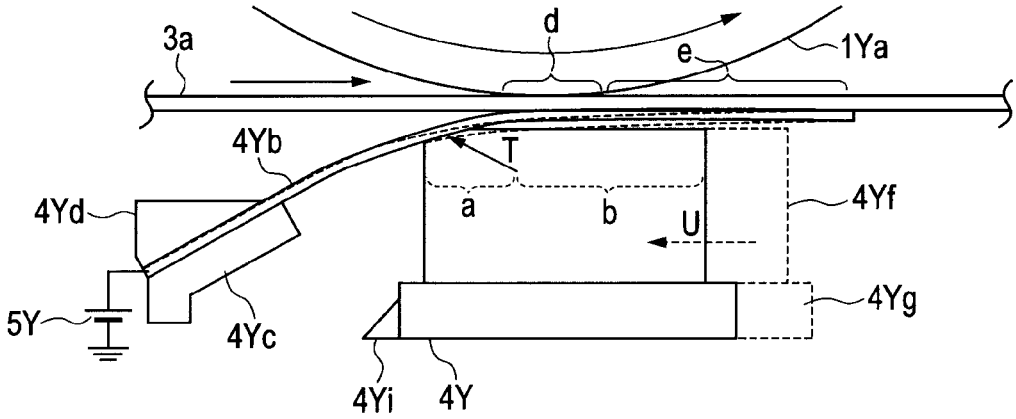

FIGS. 4A and 4B describe a method of changing a contact state between the transfer device and the intermediate transfer belt 3*a* according to the present embodiment. Each of the transfer devices 4Y to 4K uses the same method of changing pressure force, and thus, here, the configuration of the transfer device 4Y will be described. Specifically, the contact state between the sheet member 4Yb and the intermediate transfer belt 3*a* is changed by changing the pressure force of the elastic member 4Yf applied to the sheet member 4Yb.

FIG. 4A illustrates a movement trajectory of the elastic member 4Yf when the pressure force is reduced. FIG. 4B illustrates a movement trajectory of the elastic member 4Yf when the pressure force is increased. The pressure force refers to a force with which the elastic member 4Yf presses the sheet member 4Yb to the intermediate transfer belt.

The frictional force F due to rubbing between the sheet member 4Yb and the intermediate transfer belt 3*a* is determined by a product ($\mu \times N$) of a friction coefficient μ and a normal force N between the sheet member 4Yb and the intermediate transfer belt 3*a*. The normal force N is a sum ($N_1+N_2$) of a mechanical pressure $N_1$ between the sheet member 4Yb and the intermediate transfer belt 3*a* and an electrostatic adsorption force $N_2$ between the sheet member 4Yb and the intermediate transfer belt 3*a*. In the present configuration, as the sheet member 4Yb is worn to reduce surface irregularities, the contact area between the sheet member 4Yb and the intermediate transfer belt 3*a* increases. An increase in contact area increases the normal force particularly due to the electrostatic adsorption force $N_2$ and increases the frictional force F. An increase of the frictional force F in each color primary transfer portion increases the belt drive torque. Wearing of the sheet member 4Yb is easy to occur particularly in a position of the physical nip d. Therefore, in order to reduce an increase in belt drive torque, it is effective to reduce the wearing of the sheet member 4Yb in a position of the physical nip d.

As illustrated in FIG. 4A, with the sheet support portion 4Yc being fixed, the holding member 4Yg and the elastic member 4Yf are moved to a low pressing position (a second pressing position) on a downstream side in the belt moving direction. Thus, the pressure force of the elastic member 4Yf to the sheet member 4Yb can be reduced. The sheet member 4Yb with a reduced pressure force enters a state of being in contact with the intermediate transfer belt 3*a* only in a region f on the free end side with a light pressure by means of rigidity of the sheet itself. This state is hereinafter referred to as a low pressure state.

As illustrated in FIG. 4B, with the sheet support portion 4Yc being fixed, the holding member 4Yg and the elastic member 4Yf are moved to a first pressing position on an upstream side in the belt moving direction to abut the holding member 4Yg against a positioning member 4Yi. Thus, the elastic member 4Yf is moved to a position of pressing the sheet member 4Yb in a direction indicated by an arrow T with a predetermined pressure. As a result, a desired transfer nip having the physical nip d of 2 mm and the tension nip e of 2 mm or more can be formed. This state is hereinafter referred to as an image forming state.

In the present configuration, the elastic member 4Yf has a small pressure force and the sheet member 4Yb has rigidity. At this time, the respective shapes of the physical nip d and the downstream tension nip e depend mainly on the fixed position, the angle, and the sheet rigidity of the sheet member 4Yb, and are relatively less affected by the accuracy of the pressure of the elastic member 4Yf. Therefore, even if a reduction of the pressure force and an increase of the pressure force are repeated, an optimal transfer nip can always be reproduced.

Figure 5A:
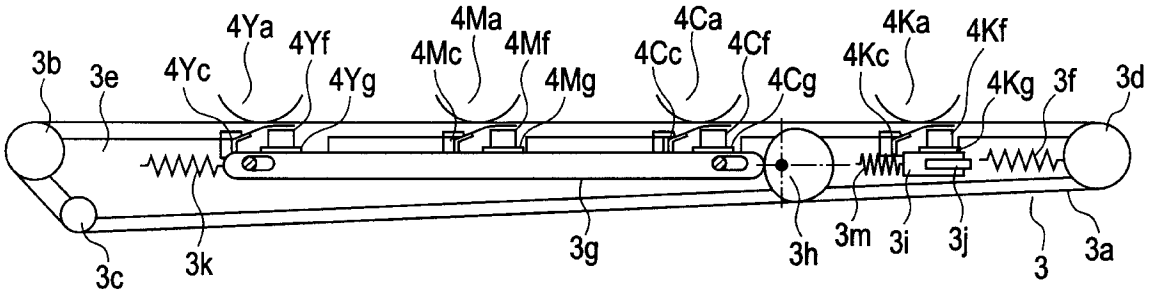
FIGS. 5A, 5B and 5C describe a pressure force change unit of the image forming apparatus according to the first embodiment.
Figure 5B:
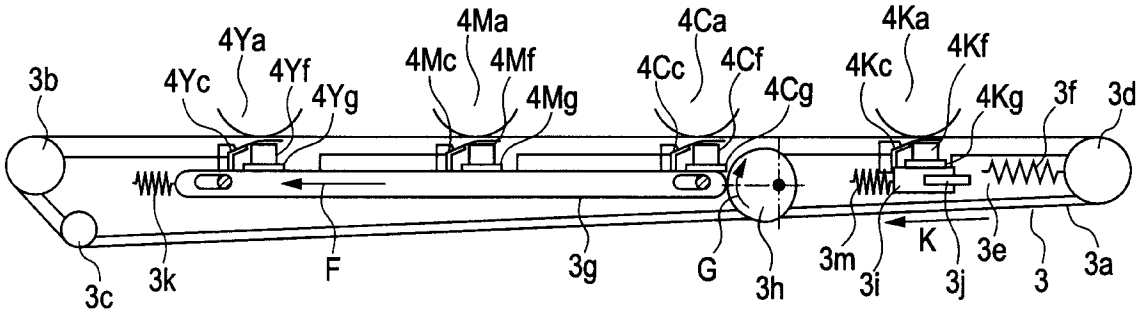
Figure 5C:
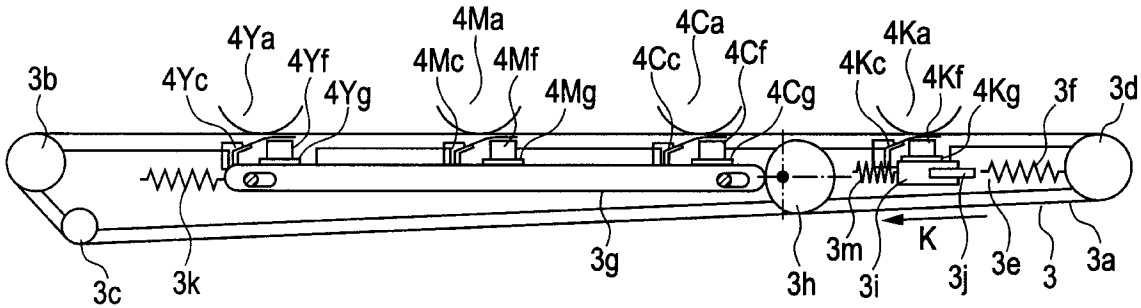

FIGS. 5A to 5C describe a moving mechanism of the transfer device. FIG. 5A is a configuration diagram of the intermediate transfer belt unit 3 in a low pressure state. FIG. 5B is a configuration diagram of the intermediate transfer belt unit 3 in a full color image forming state. FIG. 5C is a configuration diagram of the intermediate transfer belt unit 3 in a monocolor image forming state.

As illustrated in FIG. 5A, a state enters the low pressure state when power is turned on to the image forming apparatus, when the image forming apparatus is in an image-forming-ready state, or after the transfer operation completes. The intermediate transfer belt unit 3 includes a frame (transfer device support member) 3*e* and a moving unit (movable arms 3*g* and 3*i*, a solenoid 3*j*, and a cam 3*h*). The sheet support portions 4Yc, 4Mc, 4Cc, and 4Kc are fixed to the frame 3*e*.

The holding members 4Yg, 4Mg, and 4Cg are fixed to the movable arm 3*g* which is an arm member. The movable arm 3*g* is in a state of abutting against the cam 3*h* by means of an elastic force of the spring 3*k*. The cam 3*h* is disposed on a downstream side in the belt moving direction and is in a state of making an arc with a short radius on an upstream side in the belt moving direction. Thus, the sheet support portions 4Yc, 4Mc, and 4Cc together with the holding members 4Yg, 4Mg, and 4Cg move to a state of reducing the pressure force in FIG. 4A.

The holding member 4Kg is fixed to the movable arm 3*i*. The movable arm 3*i* is in a state of abutting against the solenoid 3*j* disposed on a downstream side in the belt moving direction by means of an elastic force of the spring 3*m*. The solenoid 3*j* is in a state of being retracted on a downstream side in the belt moving direction. Thus, the sheet support portion 4Kc together with the holding member 4Kg moves to a state of reducing the pressure force in FIG. 4A. The moving direction is the same as that of the intermediate transfer belt in the pressing position. Thus, the four transfer devices 4Y to 4K enter the low pressure state illustrated in FIG. 4A, and thus can avoid unnecessary wearing.

As illustrated in FIG. 5B, when the cam 3*h* makes a half turn from the low pressure state in FIG. 5A, the long radius arc of the cam 3*h* is located on an upstream side in the belt moving direction. Thus, the long radius arc of the cam 3*h* moves the movable arm 3*g* to an upstream side in the belt moving direction (in a direction indicated by an arrow F) against a biasing force of the spring 3*k*. As a result, the holding members 4Yg, 4Mg, and 4Cg as well as the elastic members 4Yf, 4Mf, and 4Cf move together with the movable arm 3*g*. Thus, the sheet support portions 4Yc, 4Mc, and 4Cc together with the holding members 4Yg, 4Mg, and 4Cg move to a state of increasing the pressure force in FIG. 4B.

The solenoid 3*j* protrudes to an upstream side in the belt moving direction from the retracted state in FIG. 5A to move the movable arm 3*i* to the upstream side in the belt moving direction. Thus, the holding member 4Kg and the elastic member 4Kf together with the movable arm 3*i* move to a state of increasing the pressure force in FIG. 4B. Thus, the four transfer devices 4Y to 4K enter the state of increasing the pressure force illustrated in FIG. 4B, which can secure an optimal contact region between the intermediate transfer belt 3*a* and the sheet members 4Yb, 4Mb, 4Cb, and 4Kb and enables full color image formation with high image quality. When this pressure force change operation is performed during belt rotation, the respective postures of the sheet members 4Yb to 4Kb are stabilized.

As illustrated in FIG. 5C, only the solenoid 3*j* is operated to move from the low pressure state in FIG. 5A to the state in FIG. 5B. At this time, the cam 3*h* is not operated. Thus, only the elastic member of the black transfer device 4K enters the first pressing position to enable monocolor image formation. Thus, only the transfer device 4K enters the image forming state, while the other transfer devices 4Y, 4M, and 4C maintain the low pressure state illustrated in FIG. 4A, which can avoid unnecessary wearing.

The present embodiment can change the contact state between the transfer device and the intermediate transfer belt by moving the pressing member of the transfer device in the state in which the position of the sheet member is fixed. Since the position of the sheet member is fixed, the change in the contact region of the transfer device can be suppressed.

Figure 6A:
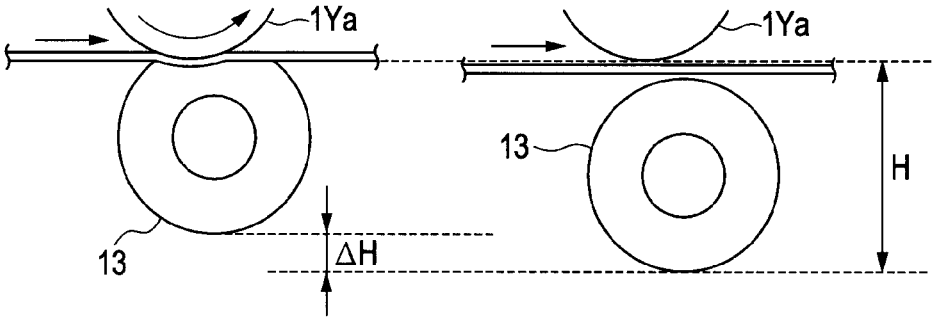
FIGS. 6A, 6B and 6C describe a pressure force change unit of a transfer device according to a comparative example.
Figure 6B:
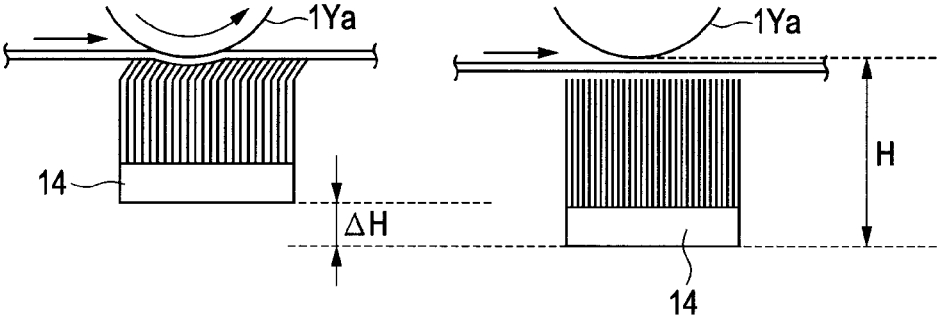
Figure 6C:
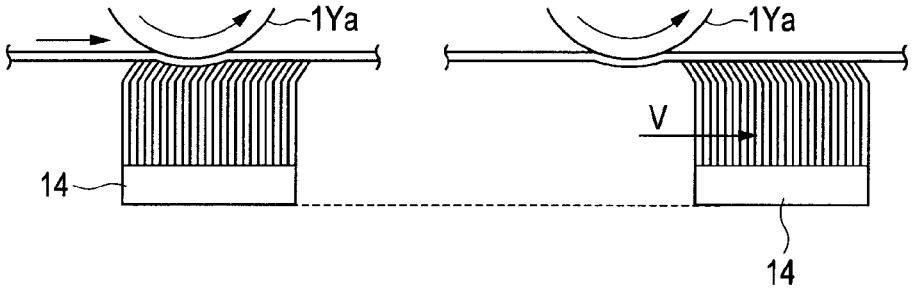

FIGS. 6A to 6C describe a pressing force change unit of a transfer device according to comparative examples. As illustrated in FIG. 6A, a comparative example 1 uses a roller 13 instead of the sheet member. As illustrated in FIG. 6B, a comparative example 2 uses a transfer brush 14 instead of the sheet member. As illustrated in FIG. 6C, a comparative example 3 moves the transfer brush 14 used instead of the sheet member to an upstream side and a downstream side in the belt moving direction.

A left part of FIG. 6A illustrates an image forming state of the comparative example 1, and a right part of FIG. 6A illustrates a low pressure state of the comparative example 1. In order to prevent toner image scattering and separation discharge, a tension nip is not provided on the upstream side, but the tension nip with a length of 2 mm or more is provided on the downstream side. In order to do that, a low hardness roller with a large diameter needs to be used and the rubber of the roller 13 needs to be greatly elastically deformed in the nip portion. In the comparative example 1, the roller 13 is configured such that a middle-resistance foam urethane layer prescribed with urethane resin, carbon black as conductive particles, sulfurizing agent, foaming agent, and the like is formed into a roller shape with a diameter of 12 mm on a SUS core bar with a diameter of 6 mm. The roller 13 has an Asker C hardness of 28 degrees. The roller 13 is pressed to the intermediate transfer belt 3*a* with a linear pressure of about 5 g/cm and is disposed so as to be rotated following the movement of the intermediate transfer belt 3*a*. As a result, in comparison with the present embodiment, the comparative example 1 is relatively high such that the difference ΔH in height between the image forming state and the low pressure state is 5 mm and the height H from the photosensitive drum 1Ya to the end portion of the transfer member is 20 mm.

A left part of FIG. 6B illustrates the image forming state of the comparative example 2, and a right part of FIG. 6B illustrates the low pressure state of the comparative example 2. A carbon fiber brush in which carbon is dispersed in acrylic resin is used as the transfer brush 14 with a filling density of 4600 fibers/inch$^2$ and a H is 15 mm. When determining ΔH of the transfer brush 14, an excellent contact with the intermediate transfer belt 3*a* has to be maintained even if a height of the transfer brush is changed due to fallen fibers. Accordingly, ΔH requires about 7 mm. A repeated change of the pressure force and rubbing with the intermediate transfer belt 3*a* for a long period of time cause a change in shape of the brush bristles. The change in shape of the brush bristles changes the respective shapes of the upstream side tension nip, the physical nip, and the downstream side tension nip, which deteriorates the image quality.

A left part of FIG. 6C illustrates the image forming state of the comparative example 3, and a right part of FIG. 6C illustrates the low pressure state of the comparative example 3. A repeated movement of the transfer brush 14 to and from the upstream side and the downstream side in the belt moving direction changes the bristle direction, which disturbs the brush shape. Like the comparative example 2, the change in shape of the brush bristles changes the respective shapes of the upstream side tension nip, the physical nip, and the downstream side tension nip, which deteriorates the image quality.

In comparison with the aforementioned comparative examples 1 to 3, the present embodiment uses smaller components and lighter pressure. Thus, despite the repeated changes of the pressure force, a desired shape of the physical nip and the downstream side tension nip can always be reproduced. As a result, the present embodiment can achieve high image quality free from toner scattering and image failure due to discharge for a long period of time. Further, the height H is as small as 7 mm, which enables the same height configuration in between the image forming state and the low pressure state, which is advantageous for space-saving design. Furthermore, the present embodiment can minimize the ratio of the pressing time to the device life, and thus can broaden the choice of materials.

Second Embodiment

Now, a second embodiment of the image forming apparatus according to the present invention will be described by referring to the accompanying drawings. Note that the same reference numerals or characters are assigned to the components that have already described and the duplicate description is omitted.

Figure 7A:
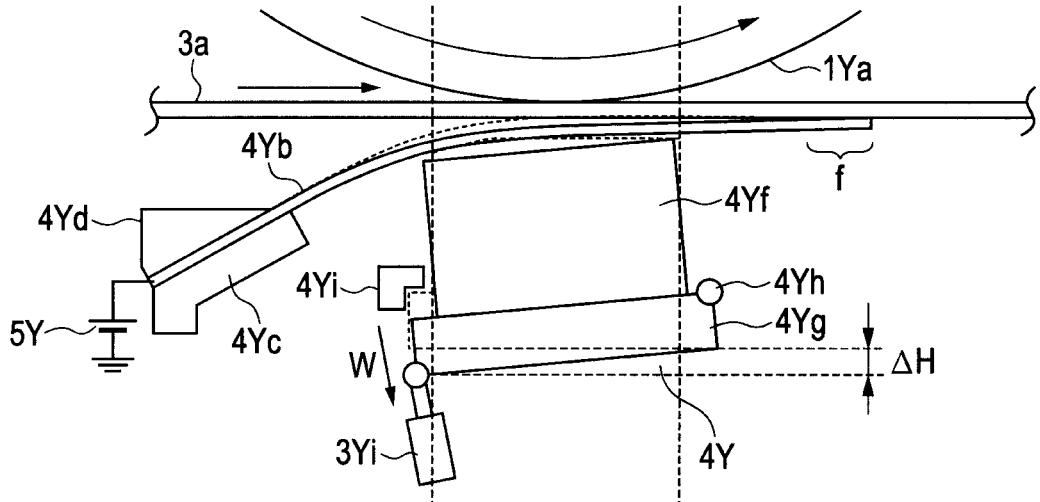
FIGS. 7A and 7B describe a pressure force change unit of a transfer device according to a second embodiment.
Figure 7B:
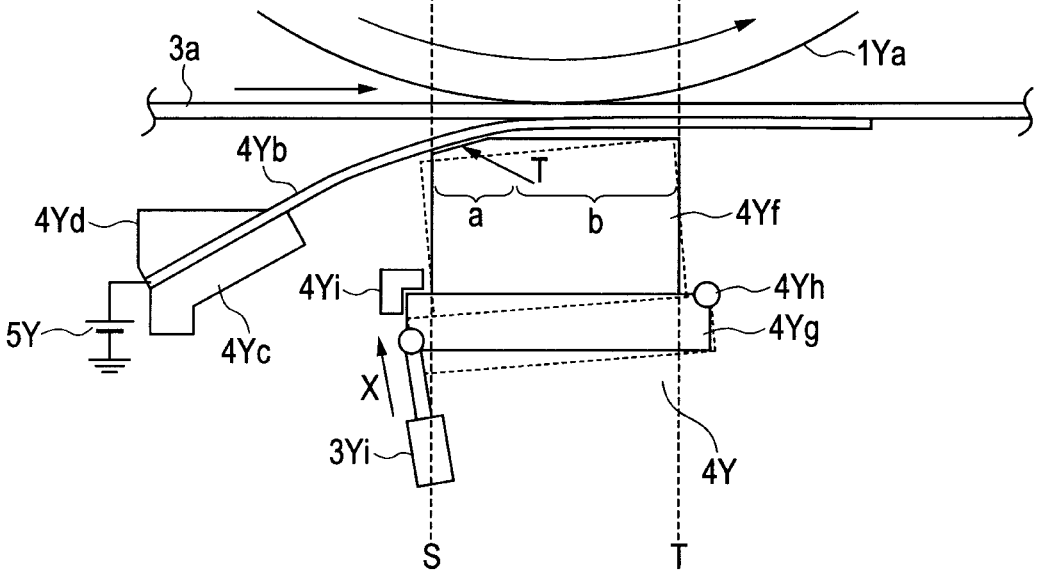

FIGS. 7A and 7B describe a pressing force change operation according to the second embodiment. FIG. 7A illustrates a movement trajectory of the elastic member 4Yf when the pressure force is reduced. FIG. 7B illustrates a movement trajectory of the elastic member 4Yf when the pressure force is increased.

Figure 8A:
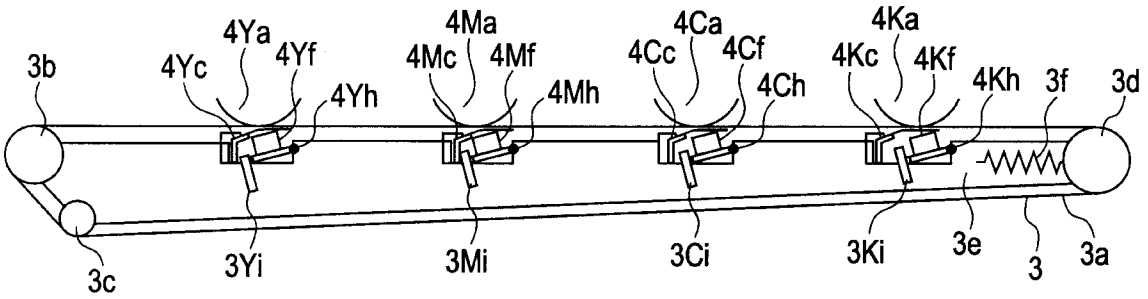
FIGS. 8A, 8B and 8C describe a pressure force change unit of an image forming apparatus according to the second embodiment.
Figure 8B:
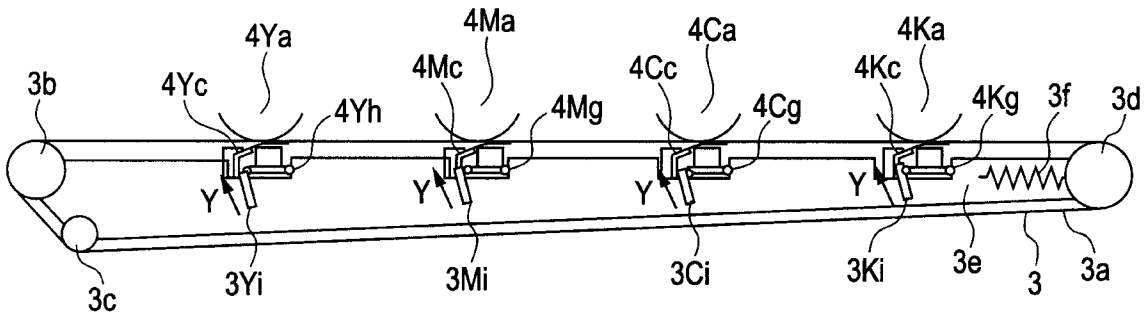
Figure 8C:
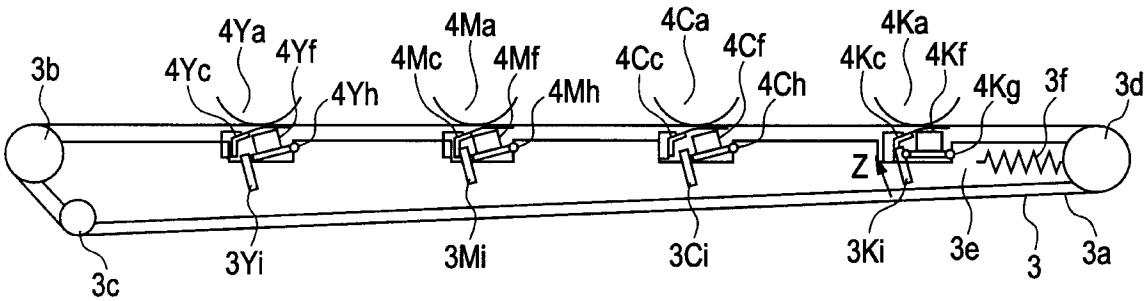

FIGS. 8A to 8C describe a moving mechanism of the transfer device. FIG. 8A is a configuration diagram of the intermediate transfer belt unit 3 in a low pressure state. FIG. 8B is a configuration diagram of the intermediate transfer belt unit 3 in a full color image forming state. FIG. 8C is a configuration diagram of the intermediate transfer belt unit 3 in a monocolor image forming state.

As illustrated in FIGS. 7A and 7B, and FIGS. 8A to 8C, the image forming apparatus according to the second embodiment has a second moving unit (solenoids 3Yi, 3Mi, 3Ci, and 3Ki) instead of the moving unit (movable arms 3*g* and 3*i*, solenoid 3*j*, and cam 3*h*) according to the first embodiment, wherein the holding members 4Yg to 4Kg can be rotated around the rotational centers 4Yh to 4Kh respectively.

As illustrated in FIG. 7A, in a state of the solenoid 3Yi being retracted, the holding member 4Yg rotates in a direction away from the sheet support portion 4Yc (in a direction indicated by an arrow W) around the rotational center 4Yh on a downstream side in the belt moving direction. Thus, the elastic member 4Yf reduces the pressure force to the sheet member 4Yb to place the sheet member 4Yb and the elastic member 4Yf in a contactless state. That is, the pressing member presses a part of the sheet member in a first position, and the moving unit moves the pressing member to a second position which is located farther away from the part of the sheet member pressed by the pressing member in a first position than the first position. The rotational center 4Yh is fixed to the frame 3*e* in the same manner as the sheet support portion 4Yc. The moving distance ΔH due to rotation is about 1.5 mm.

As illustrated in FIG. 7B, when the solenoid 3Yi protrudes, the holding member 4Yg rotates in a direction (in a direction indicated by an arrow X) of moving close to the sheet support portion 4Yc around the rotational center 4Yh. The holding member 4Yg abuts against the positioning member 4Yi. Thus, the elastic member 4Yf can press the sheet member 4Yb in a direction indicated by an arrow T with a predetermined pressure. As a result, a desired transfer nip having the physical nip d of 2 mm and the tension nip e of 2 mm or more can be formed again.

Like the first embodiment, when all transfer devices 4Y to 4K are not used, as illustrated in FIG. 8A, all solenoids 3Yi, 3Mi, 3Ci, and 3Ki are placed in the respective retracted states and all transfer devices 4Y to 4K are placed in the respective low pressure force states. This configuration can avoid unnecessary wearing.

In order to form full color images, as illustrated in FIG. 8B, all solenoids 3Yi to 3Ki are made to protrude so as to place all transfer devices 4Y to 4K in a pressure force increasing state in FIG. 7B. This configuration can secure respective optimal contact regions between the intermediate transfer belt 3*a* and the sheet members 4Yb to 4Kb to form high quality full color images.

When monocolor images are formed, as illustrated in FIG. 8C, only the solenoid 3Ki is made to protrude and the other solenoids 3Yi to 3Ci are placed in the respective retracted states. Then, only the transfer device 4K is placed in the image forming state and the other transfer devices 4Y to 4C are placed in the low pressure state, and thus unnecessary wearing can be avoided.

The second embodiment can exert similar effects to those of the first embodiment. In the second embodiment, the holding member 4Yg is fixed to the frame 3*e* by means of the rotational center 4Yh. Accordingly, in this configuration, the sheet support portion 4Yc and the rotational center 4Yh are fixed to the frame 3*e* made of the same component. Thus, when a pressure force reducing operation and a pressure force increasing operation are repeated, in comparison with the first embodiment in which the holding member 4Yg moves in parallel, the configuration is advantageous in increasing the positional accuracy of the end portions of the elastic member 4Yf each indicated by dotted lines S and T in FIGS. 7A and 7B. The high positional accuracy of the end portions of the elastic member 4Yf can maintain high positional accuracy of the desired transfer nip. That is, even if the image forming apparatus is used for a long period of time, stable and high image quality can be maintained.

The present invention can be applied to a conveyor belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-144362, filed Jun. 25, 2010, which is hereby incorporated by reference herein in its entirety.

What is claimed is:

1. An image forming apparatus, comprising:

an image bearing member bearing a toner image;

an endless rotatable transfer belt for transferring the toner image from the image bearing member to a transfer material;

a transfer device transferring the toner image from the image bearing member to the transfer belt, the transfer device having a sheet member, one end of which is fixed and the other end of which comes in contact with an inner peripheral surface of the transfer belt, and a pressing member for pressing the sheet member to the transfer belt; and a moving unit moving the pressing member, wherein the moving unit moves the pressing member in a moving direction of the transfer belt so that a contact state of the sheet member with respect to the transfer belt is changed.

2. An image forming apparatus according to claim 1, wherein, in the moving direction of the transfer belt, the one end of the sheet member is fixed and the other end of the sheet member is a free end, and a fixed position of the sheet member is not changed by the moving unit.

3. An image forming apparatus according to claim 1, further comprising a voltage applying unit applying a bias to the sheet member.

4. An image forming apparatus according to claim 1, wherein the pressing member is movable in the moving direction of the transfer belt at least between a first pressing position and a second pressing position, and a position of the pressing member when the toner image is transferred from the image bearing member is the first pressing position.

5. An image forming apparatus according to claim 4, wherein a pressure force applied to the transfer belt by the pressing member located at the first pressing position is greater than a pressure force applied to the transfer belt by the pressing member located at the second pressing position.

6. An image forming apparatus according to claim 4, wherein the second pressing position is closer to a downstream side in the moving direction of the transfer belt than the first pressing position.

7. An image forming apparatus according to claim 6, wherein the transfer device has a holding member holding the pressing member, and the moving unit has an arm member in which a cam and the holding member are fixed, and the arm member is moved by rotation of the cam.

8. An image forming apparatus according to claim 4, wherein the moving unit moves the pressing member to the first pressing position and the second pressing position by rotating the pressing member.

9. An image forming apparatus according to claim 8, wherein the second pressing position is located farther away from an inner peripheral surface of the transfer belt than the first pressing position.

10. An image forming apparatus according to claim 8, wherein the transfer device has a holding member holding the pressing member, the holding member can be rotated around a rotational center, and a member holding the rotational center and the sheet member is supported by one frame.

11. An image forming apparatus according to claim 8, wherein the transfer belt is an intermediate transfer belt to which the toner image is transferred from the image bearing member.

12. An image forming apparatus according to claim 8, wherein the transfer belt is a conveyor belt conveying the transfer material to which the toner image is transferred from the image bearing member.

13. An image forming apparatus according to claim 1, wherein the pressing member is an elastic member which is capable of being contacted with and separated from the sheet member by the moving unit.

14. An image forming apparatus according to claim 13, wherein the pressing member is a foam sponge-like member and has an approximately cuboid shape.

* * * * *